US006848851B2

(12) United States Patent
Yokouchi

(10) Patent No.: US 6,848,851 B2
(45) Date of Patent: Feb. 1, 2005

(54) WRITING IMPLEMENT

(75) Inventor: Nobuo Yokouchi, Chuo-ku (JP)

(73) Assignee: Pentel Kabushiki Kaisha, Chuo-ku (JP)

( * ) Notice: Subject to any disclaimer, the term of this patent is extended or adjusted under 35 U.S.C. 154(b) by 0 days.

(21) Appl. No.: 10/468,631

(22) PCT Filed: Feb. 26, 2002

(86) PCT No.: PCT/JP02/01726

§ 371 (c)(1),
(2), (4) Date: Aug. 20, 2003

(87) PCT Pub. No.: WO02/068211

PCT Pub. Date: Sep. 6, 2002

(65) Prior Publication Data

US 2004/0091302 A1 May 13, 2004

(30) Foreign Application Priority Data

Feb. 28, 2001 (JP) ..... 2001-053860
Jun. 28, 2001 (JP) ..... 2001-197498
Nov. 20, 2001 (JP) ..... 2001-355102

(51) Int. Cl.[7] ..... A46B 5/02
(52) U.S. Cl. ..... 401/6
(58) Field of Search ..... 401/6, 48; D19/45, D19/47, 48

(56) References Cited

U.S. PATENT DOCUMENTS 360,298 A * 3/1887 Hewitt ..... 15/435
1,376,115 A * 4/1921 Record ..... 401/6
1,747,167 A * 2/1930 Hill ..... 15/443
D178,632 S * 9/1956 Bloser ..... D19/48
4,056,325 A * 11/1977 Maruyama ..... 401/65
D338,915 S * 8/1993 Willat ..... D19/51
D363,310 S * 10/1995 Oka ..... D19/55
5,558,452 A * 9/1996 Oka et al. ..... 401/6
6,164,855 A * 12/2000 Perry et al. ..... 401/6
6,206,595 B1 * 3/2001 Keda ..... 401/6
D442,991 S * 5/2001 Smith ..... D19/47
D443,644 S * 6/2001 Lewis et al. ..... D19/47
6,533,483 B2 * 3/2003 Carroll et al. ..... 401/194

FOREIGN PATENT DOCUMENTS

JP 4047574 4/1992
JP 5177979 7/1993
JP 8300878 11/1996
JP 9169191 6/1997

OTHER PUBLICATIONS

Mitsubishi Enpitsu Sogo Catalog 1997 (General Catalog of Mitsubishi Pencil Co.) p. 74; item description of iten No. [MSE–500B'S] p. 75; item description of item No. [WBS–350B'S].

* cited by examiner

*Primary Examiner*—Gregory L. Huson
*Assistant Examiner*—Huyen Le
(74) *Attorney, Agent, or Firm*—Adams & Wilks

(57) ABSTRACT

At the time of gripping a writing instrument, a certain degree of gripping force is required for the thumb and other fingers gripping the grip section so that the grip section will not slip. The normal way for supporting the writing instrument only at three points by the thumb, the index finger and the middle finger is not enough for reducing the loads to the thumb and other fingers because excessively large force is unconsciously exerted to the thumb and other fingers. It is also difficult to put the writing instrument in a pocket, a pencil case, etc. When gripping the writing instrument, the direction for gripping the barrel is forcibly determined. The present invention provides a writing instrument including a barrel, the barrel comprising an enlarged-diameter section formed generally at a lengthwise central area thereof, a grip section disposed at a front part of the enlarged-diameter section and an interdigital abutment section disposed at a rear part of the enlarged-diameter section, the interdigital abutment section having a reduced-diameter.

19 Claims, 12 Drawing Sheets

WRITING IMPLEMENT

CROSS-REFERENCE TO RELATED APPLICATIONS

This application is a U.S. national stage application of copending International Application No. PCT/JP02/01726, filed Feb. 26, 2002 and published in a non-English language.

TECHNICAL FIELD

This invention relates to a barrel of a writing instrument, and more particularly to the configuration of the barrel which is designed such that the writing instrument can be gripped with small force.

BACKGROUND OF THE INVENTION

In the conventional writing instrument, many products and inventions are known which are made in consideration of reduction of fatigue of finger gripping the grip section and slip resistance. One such example is Japanese Patent Application Laid-Open Publication No. 05-177,979. Claim 1 of this Publication reads as "an auxiliary tool for holding a writing tool which can be used in combination with a writing tool 1, comprising a first ring 2 having an inner diameter which can be engaged fast with the writing tool 1 and a peripheral shape larger than a cross section of the writing tool 1, which can be fixed at an optional position of the tool 1 and a holder 3 including an annular part 4 which can be engaged with the writing tool 1 idly and has an inner diameter slightly smaller than the outer diameter of the ring 2 and a member 6 (10) which can be grasped by a palm relating to the annular part 4, the holder 3 being able to idly engage with the writing tool 1 at a position higher than the ring 2". That is, this conventional device aims at reducing fatigue of hand, arm and shoulder by providing a support part other than finger.

However, a certain degree of gripping force is required for the thumb and other fingers gripping the grip section so that the grip section will not slip. The normal way for supporting the writing instrument only at three points by the thumb, the index finger and the middle finger is not enough for reducing the loads to the thumb and other fingers because excessively large force is unconsciously exerted to the thumb and other fingers.

Moreover, the attempt for attaching a support member to the barrel so as to be held in the palm of the hand tends to jeopardize portability of the writing instrument and easy handling thereof. That is, the conventional writing instrument of the type just mentioned is difficult to be put in a pocket, a pencil case, etc. When gripping the writing instrument, the direction for gripping the barrel is forcibly determined.

SUMMARY OF THE INVENTION

The present invention has been made in view of the above-mentioned problems. The subject matter of the present invention resides in a writing instrument including a barrel, the barrel comprising an enlarged-diameter section formed generally at a lengthwise central area thereof, a grip section disposed at a front part of the enlarged-diameter section and an interdigital abutment section disposed at a rear part of the enlarged-diameter section, the interdigital abutment section having a reduced-diameter.

DETAILED DESCRIPTION OF THE INVENTION

Figure 1:
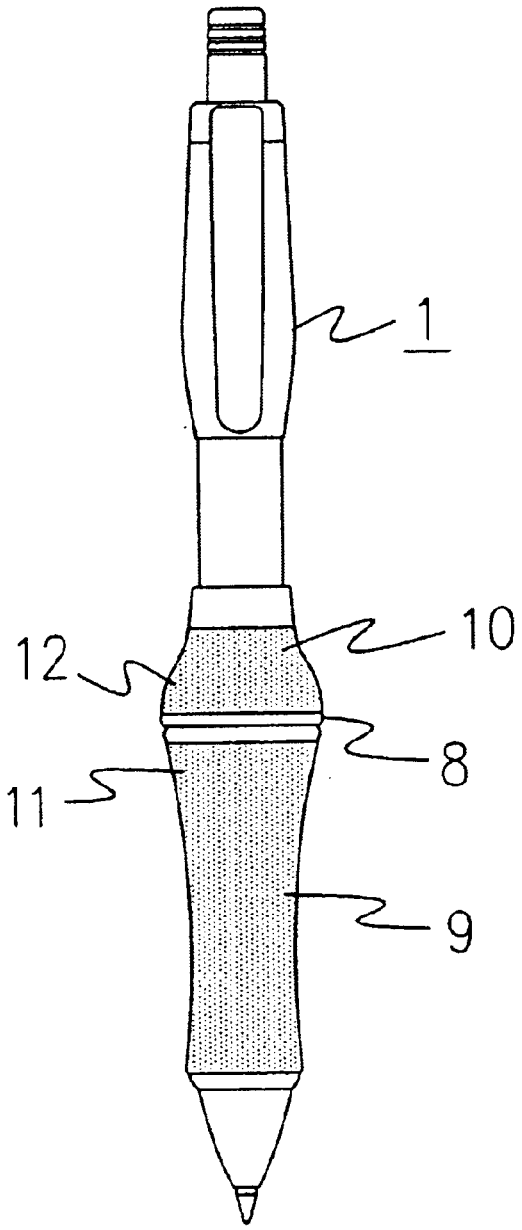
FIG. 1 is a front elevation of a writing instrument according to a first embodiment of the present invention.
Figure 2:
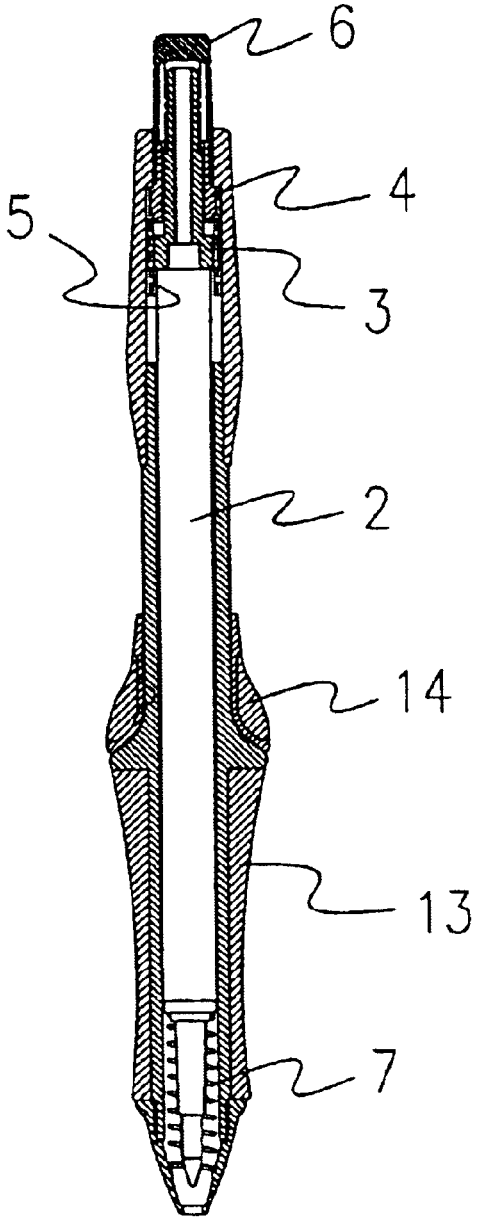
FIG. 2 is a vertical sectional view of the writing instrument shown in FIG. 1.

The first embodiment of the present invention will be described with reference to FIGS. 1 through 6. A centering mechanism of a mechanical pencil, a refill of a ball-point pen, etc. is received and arranged in a barrel 1. The barrel 1 according to this embodiment contains therein a refill 2 of a ball-point pen. In addition, the barrel 1 includes a rotor 3, a slider 4, a cam groove 5, a knock member 6 and a spring 7. That is, the first embodiment shows a retractable ball-point pen. It should be noted that the words "above part" in those Figures of the drawing hereinafter refers to the "rear part" of the writing instrument and the "lower part", to the "front part" of the writing instrument, respectively.

Figure 3:
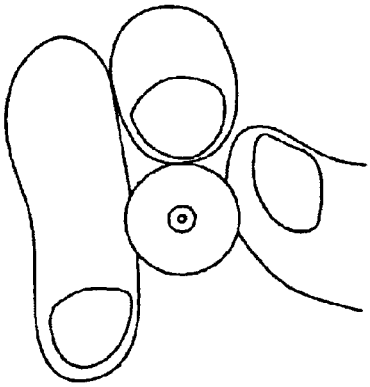
FIG. 3 is a diagrammatic front view showing a part of the writing instrument gripped with fingers of a user in a griping state.
Figure 4:
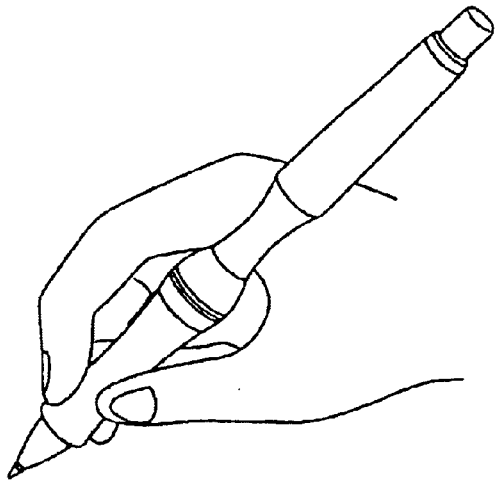
FIG. 4 is an explanatory perspective view of the writing instrument and the gripping state shown in FIG. 3.
Figure 5:
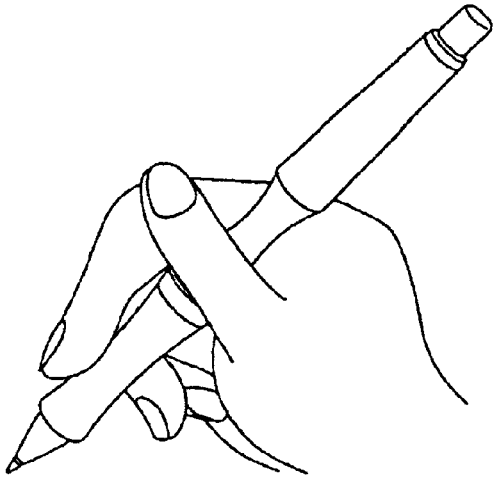
FIG. 5 is an explanatory perspective view showing another way and posture of gripping of the writing instrument.

The barrel 1 is provided generally at a lengthwise central area thereof with an enlarged-diameter section ("bulge" portion) 8. The barrel 1 includes a grip section 9 at a front part of the enlarged-diameter section 8 and an interdigital abutment section 10 at a rear part thereof. The grip section 9 and the interdigital abutment section 10 are separately formed on the barrel 1 in their reduced-diameter states by a front reduced-diameter section 11 and a rear reduced-diameter section 12 which are continuous with the enlarged-diameter section 8. However, they may be integrally formed. In the ball-point pen having the above-mentioned configuration, when the grip section 9 is gripped at three points with the thumb, the index finger and the middle finger in such a manner as to surround the grip section 9 as illustrated in FIG. 3, the interdigital abutment section 10 comes into abutment with the web part between the thumb and the index finger. As a result, the rear reduced-diameter section 12 disposed at the front part of the interdigital abutment section 10 is supported by root parts of the thumb and the index finger (see FIG. 4). This supporting force serves as an auxiliary of a writing load, thereby enabling to reduce the load to the thumb and other fingers gripping the grip section 9. The grip section 9 and the interdigital abutment section 10 are formed, for the purpose of slip resistance, of elastic members 13, 14, respectively, which provide a lip-resistant surface and which are composed of such material as thermoplastic elastomer, silicon, NBR and the like. It is also accepted that a coating material, or the like, capable of providing a slip resisting effect is applied to those sections 9 and 10 and hardened.

When the grip section 9 is gripped such that the section 9 is supported at two points by the index finger and the middle finger and the interdigital abutment section 10 is supported by the root parts of the thumb and the index finger (see FIG. 5), the interdigital abutment section 10 can be supported in a stable manner and a writing load can surely be applied to the rear reduced-diameter section 12. Also in this case, writing can be made without a need of a large gripping force. Thus, fatigue caused by the writing operation can be reduced. Although the number of persons who hold a writing instrument in the manner as mentioned above is comparatively small, it is increasing. According to a survey carried out by the present applicant, 7 out of 42 young persons around 18 years old, i.e., 16%, showed this way of holding of a writing instrument.

Figure 6:
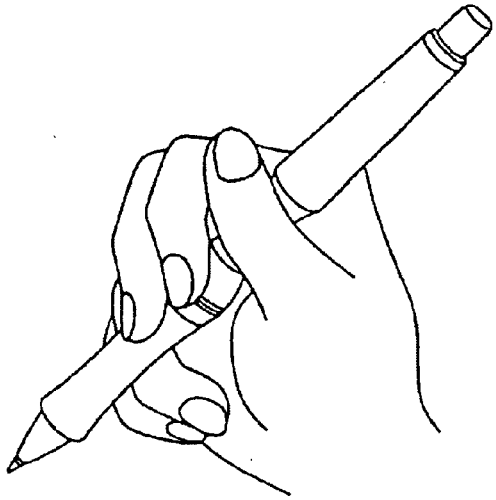
FIG. 6 is an explanatory perspective view showing still another way and posture of the gripping state.

Another way of holding a writing instrument will be described with reference to FIG. 6. In this example, the center of the barrel 1 (FIG. 1) is "grabbed by hand" (with four fingers). The enlarged-diameter section 8 and the front and rear reduced-diameter sections 11, 12, which are disposed at a front part and a rear part of the enlarged-diameter section 8 serving as a border of the sections 11 and 12, are surely contacted with respective parts of user's palm and, therefore, the writing instrument can be gripped in a stable manner and a sufficiently large writing load can be obtained. This embodiment is an example which can cope with those persons who have a relatively weak gripping force.

Figure 7:
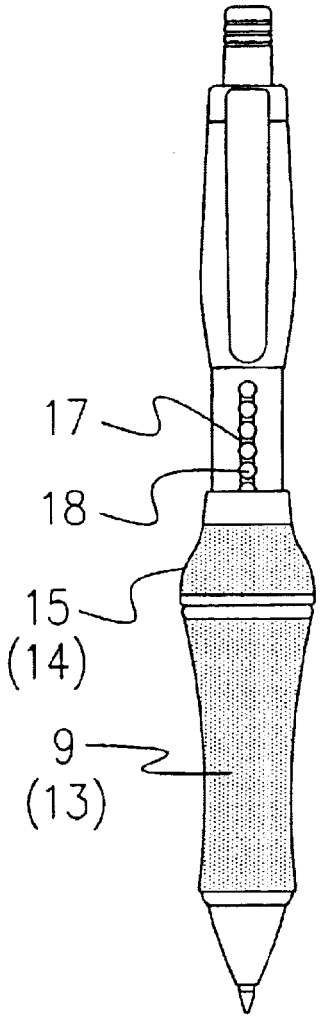
FIG. 7 is a front view of the writing instrument according to a second embodiment of the present invention.
Figure 8:
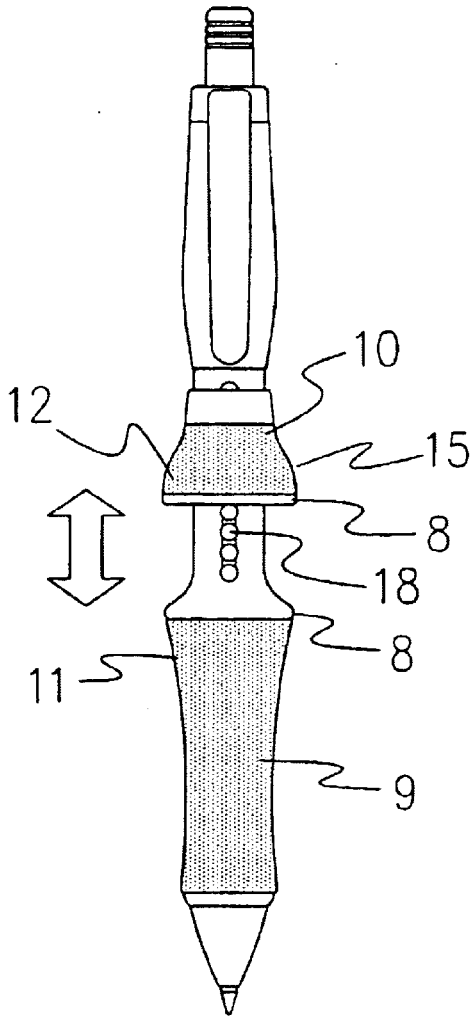
FIG. 8 is a front view of the writing instrument according to the second embodiment, showing one example of operation thereof.
Figure 9:
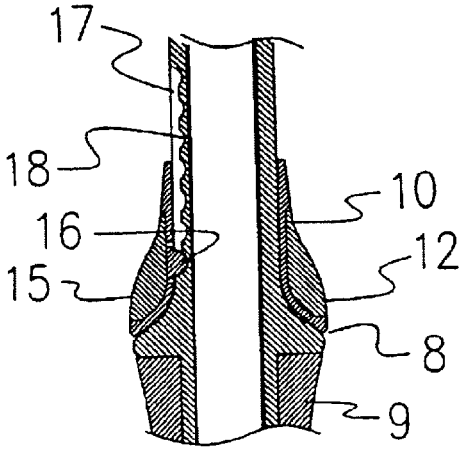
FIG. 9 is a detailed view of a part of the writing instrument according to the second embodiment.

Another example will be described with reference to FIGS. 7 through 9, in which the enlarged-diameter section 8 can move in the longitudinal direction of the barrel 1. The barrel 1 is fixedly formed with an elastic member 13 which is disposed at a front part of the enlarged-diameter section 8 and serves as a border of the section 8 and which thereby forms the grip section 9. Also, the barrel 1 is slidingly movably provided at a rear part of the enlarged-diameter section 8, likewise serving as a border of the section 8, with a movable member 15 which includes the rear reduced-diameter section 12 and the interdigital abutment member 10 and to which an elastic member 14 is attached. The movable member 15 is provided at an inner side thereof with an elastic projection 16 which is projected and biased in the axial direction of the barrel 1. On the other hand, the barrel 1 has a groove 17 linearly extending in the longitudinal direction. The depth of the groove 17 is smaller than the projecting amount of the projection 16. The projection 16 of the movable member 15 can slidingly move on the groove 17. The groove 17 is provided with a plurality of recesses 18 which are arranged therein at constant intervals of, for example, 2 mm to 4 mm. Each recess 18 has a depth generally equal to the projecting amount of the projection 16. Owing to this arrangement, when the projection 16 comes into engagement with one of the recesses 18, the movable member 16 is positionally fixed. By those mechanisms, the enlarged-diameter section 8, the rear reduced-diameter section 12 and the interdigital abutment section 10 can be axially adjusted in position when the user grips the barrel 1 in such a manner as to correspond to the size of the user's hand. In the example of FIG. 7, the barrel 1 is gripped by a user who has a relatively small hand, and in the example of FIG 8, the barrel 1 is gripped by a user who has a relatively large hand.

Figure 10:
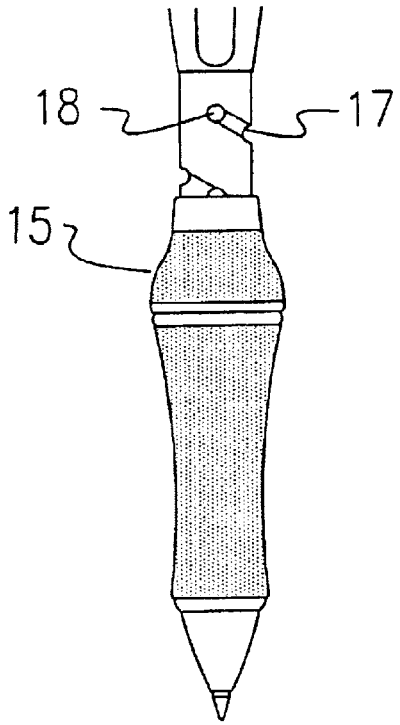
FIG. 10 is a front view of a part of the writing instrument according to a third embodiment of the present invention.
Figure 11:
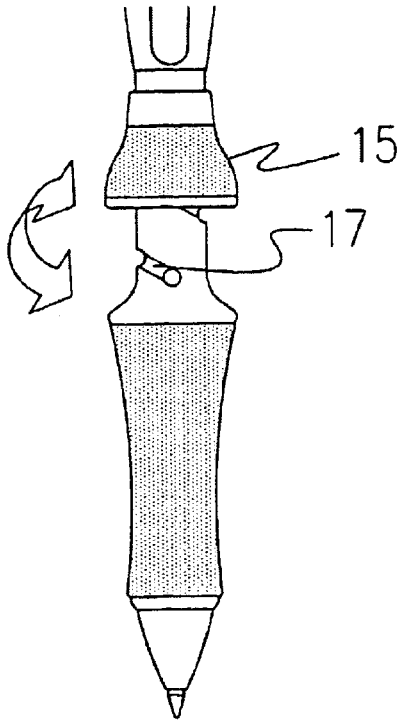
FIG. 11 is a front view of the writing instrument according to the third embodiment of the invention, showing one example of operation thereof.

A modified embodiment will now be described with reference to FIGS. 10 and 11. In this modified embodiment, the movable member 15, which includes the rear reduced-diameter section 12 and the interdigital abutment section 10, is unchanged, but the groove 17 formed in the barrel 17 is spirally extended with respect to the barrel 1. The groove 17 is provided with the recesses 18 which are formed therein at constant intervals. When the movable member 15 is to be adjusted in position, if the movable member 15 is rotationally operated rather than linearly operated as in the above-mentioned embodiment, the operating distance is increased presuming that the adjustment distance is same. Owing to this feature, it can effectively be prevented that the user accidentally overly moves the movable member 15 beyond his or her intended position when he or she makes adjustment of position by slidingly moving the movable member 15.

Figure 12:
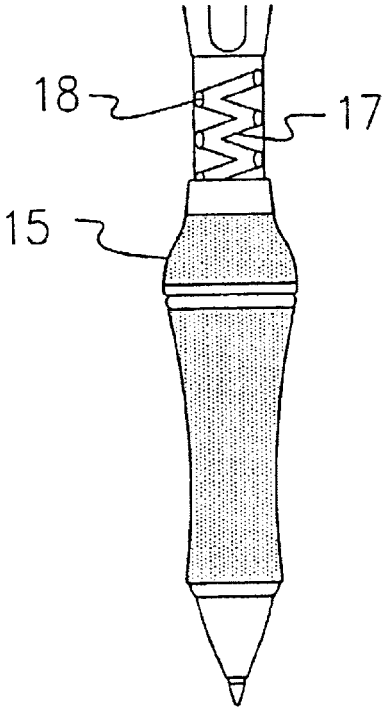
FIG. 12 is a front view of the writing instrument according to a fourth embodiment of the present invention.
Figure 13:
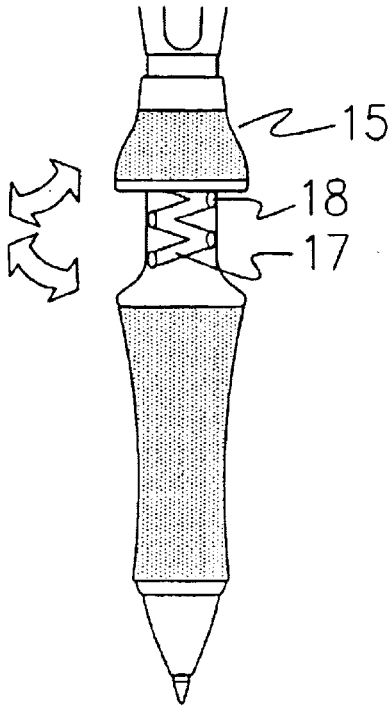
FIG. 13 is a front view of the writing instrument according to the fourth embodiment of the invention, showing one example of operation thereof.

Another modified embodiment will be described with reference to FIGS. 12 and 13. As in the preceding modified embodiment, the movable member 15 and the projection 16 are the same, but the groove 17 formed in the barrel 1 is spirally extended such that the groove 17 repeatedly turns rightward and leftward alternately while keeping its slanted posture for a constant interval. In other words, the groove 17 of this modified embodiment is of the so-called switch back type. The recesses 18 are formed in places where the turning direction of the groove 17 is changed. In other words, each recess 18 is formed in each turning point of the switch back shape. Owing to this arrangement, it can be prevented that the user accidentally overly moves the movable member 15 beyond his intended position when he makes adjustment of position by slidingly moving the movable member 15. Thus, the movable member 15 can surely be slidingly moved for a constant distance and operability is enhanced.

The following experiments were carried out using the writing instrument thus constructed.

Figure 14:
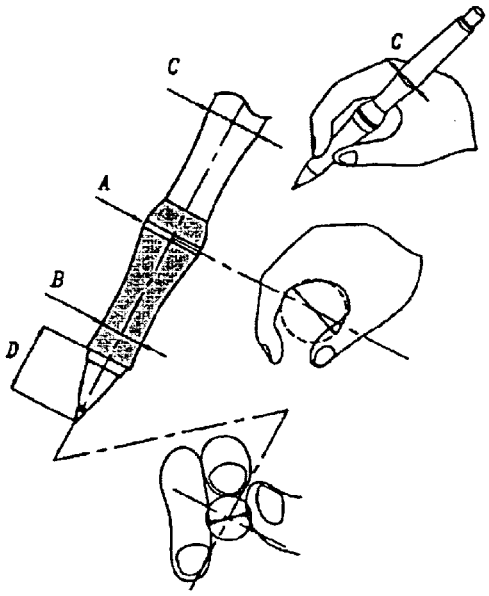
FIG. 14 is a diagram showing factors in Experiment 1.
Figure 15:
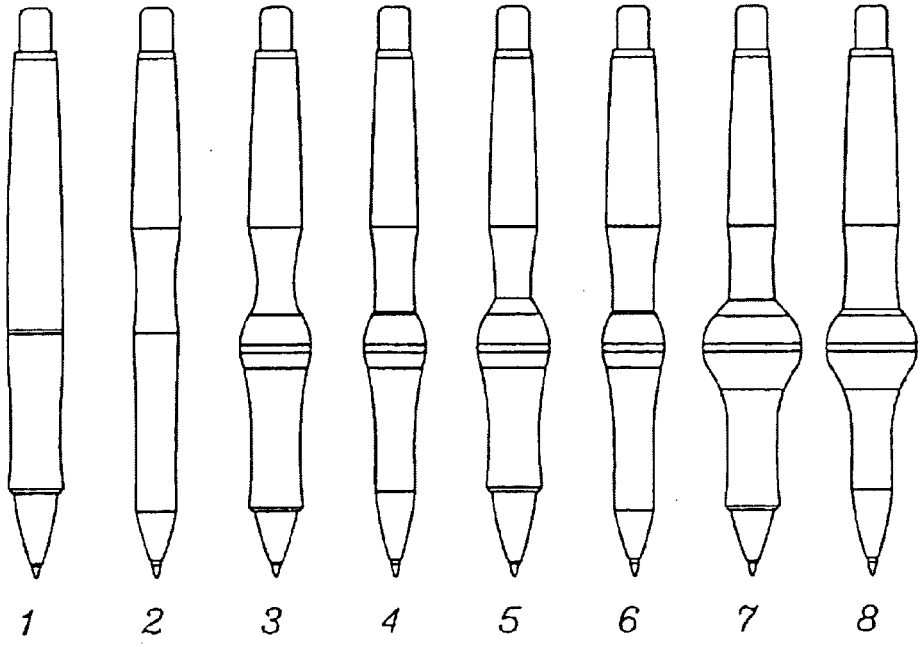
FIG. 15 is an outer appearance view of the writing instruments used for Experiment 1.
Figure 16:
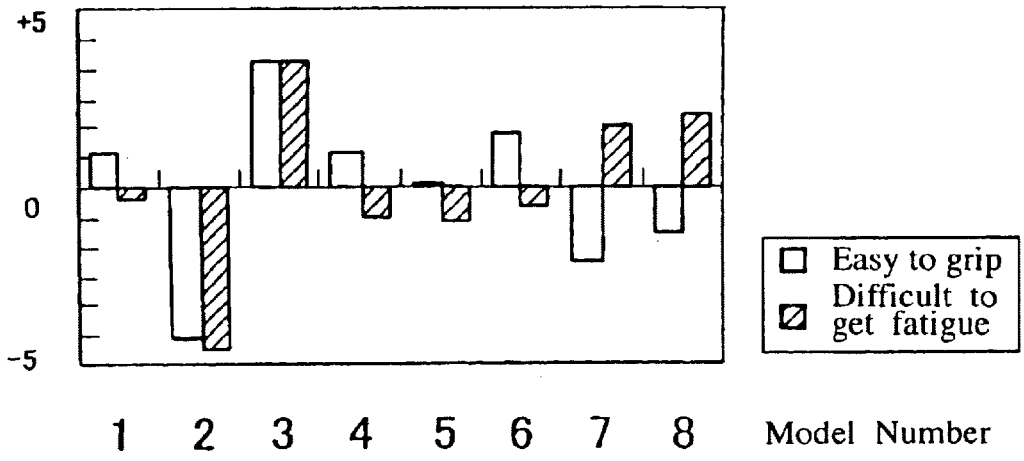
FIG. 16 is a graph showing the result of subjective evaluation of Experiment 1.

In experiment 1, the configuration of the writing instrument was checked in accordance with the design of experiment method, and eight models of four factors A, B, C, D and two levels (partly three levels) shown in FIG. 14 were made using an orthogonal array $L_8$ ($2^7$). All of the eight models used in this experiment 1 are shown in FIG. 15. In this experiment, paired comparison test was made for each model at five stages and a subjective evaluation was made with respect to the items "easy to grip" and "difficult to get fatigue". The number of persons to be tested (or, subject) was ten (adult male and female: five each, all right-handed). As a result, the model 3 was high in evaluation with respect to both the items "easy to grip" and "difficult to get fatigue", and the models 7 and 8 were high in evaluation with respect to only one item "difficult to get fatigue" (see FIG. 16). Also, as a result of an analysis of variance, it became clear that the main effect of the factors A, B, C was significant with respect to the item "difficult to get fatigue".

Figure 17:
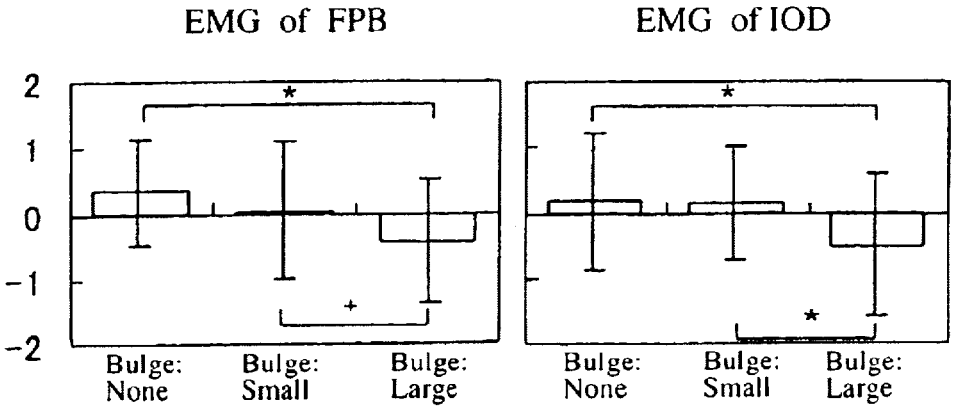
FIG. 17 is a diagram showing the result of an electromyogram, or EMG, of Experiment 2.

In experiment 2, electromyogram (hereinafter referred to as "EMG") and writing pressure were measured. EMG was drawn (band: 5 to 100 Hz and sampling frequency: 250 Hz)) from the flexor pollicis brevis (hereinafter referred to as "FPB") of the right hand and the dorsal interosseous (hereinafter referred to as "IOD"). Our own specific measuring instrument (rated writing pressure: 600 gf, precision: ±3% FS) was used for measurement of writing pressure. The number of tested persons (or, subject) was ten (adult male and female: 4 and 6, respectively, all right-handed). The models used in this experiment 2 had nine (9) conditions; a model 9 in which the position adjustment part of the enlarged-diameter section (barrel part) of the model 3 was fixed, was added to the 8 models used in experiment 1. As a result of analysis of variance, no significant main effect could be obtained for all the factors relating to writing pressure. On the other hand, the main effect of the enlarged-diameter section 8 was significant in average amplitude of EMG for both FPB and IOD, and as a result of an interlevel examination, it became clear that the larger the enlarged-diameter section 8 is, the smaller the load applicable to the muscle becomes (see FIG. 17).

Through the above-mentioned experiments 1 and 2, the effect of the enlarged-diameter section 8 obtained both a subjective and an objective positive evidences relating to reduction of the writing load.

Figure 18:
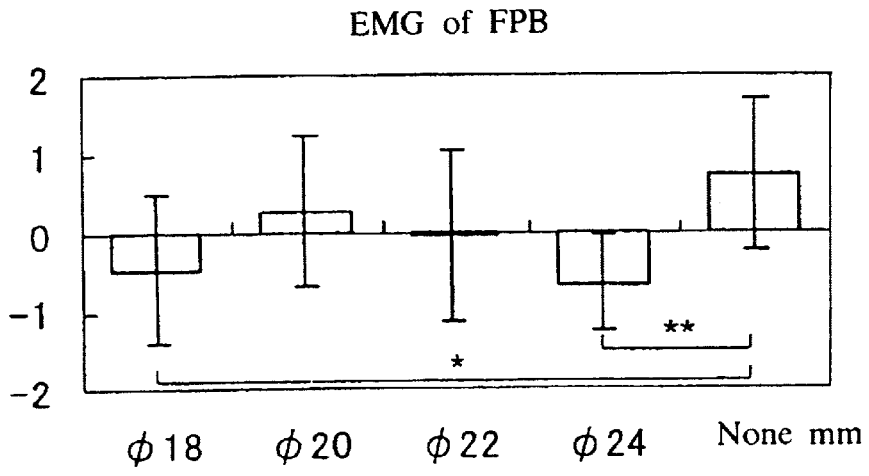
FIG. 18 is a diagram showing the result of EMG of Experiment 3.
Figure 19:
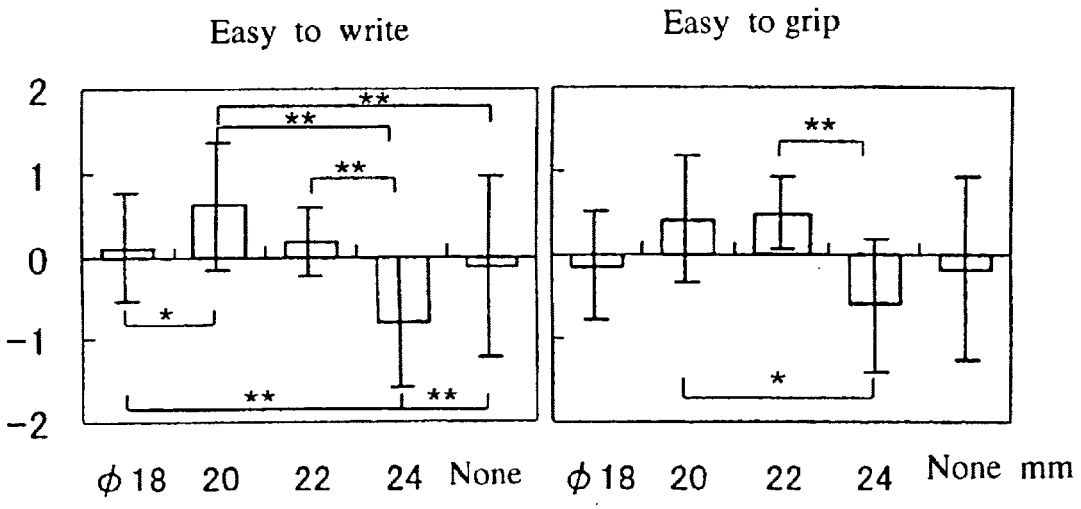
FIG. 19 is a diagram showing the result of subjective evaluation of Experiment 3.

In experiment 3, it was an object here to make clear of its optimum value serving the enlarged-diameter section 8 as a factor. There were totally five conditions in which the levels (diameters of the enlarged-diameter sections) were 18 mm, 20 mm, 24 mm and a general writing instrument having no enlarged-diameter section 8 as a "control" (comparative example). As in the experiments 1 and 2, the models each had an adjustment mechanism for adjusting the axial position of the enlarged-diameter section 8. Each tested person optionally made adjustment. The measuring items were EMG of FPB and writing pressure (same as in the experiment 2). The items "easy to write" and "easy to grip" were selected for subjective evaluation. The tested persons were 10 students (5 each of male and female, all right-handed). As a result of analysis of variance of a first-dimensional arrangement and interlevel examination see (FIG. 18), the models of 18 mm diameter and 24 mm diameter were significantly small in muscle active amount compared with the "control". In other words, effectiveness of the enlarged-diameter section 8 was supported and the effect of the model having such a smaller enlarged-diameter section as 18 mm diameter was also proved. Moreover, no difference was found between the model of 18 mm diameter and the model of 20 mm diameter. With respect to the subjective evaluation, the model of 24 mm diameter was lowest in both "easy to write" and "easy to grip". With respect to "easy to grip", the model of 20 mm diameter had a high evaluation but no difference was found between the model of 18 mm diameter and the model of 20 mm diameter. With respect to "easy to write", the model of 20 mm diameter had the highest evaluation and then the models of 18 mm and 22 mm diameters had the next highest evaluation in order (see FIG. 19).

When EMG and the subjective evaluation are totally judged from the foregoing, it can be said that the models having the enlarged-diameter section 8 whose diameter is in the range of from about 18 mm to 20 mm are most suitable in respect of fatigue, easy to write and easy to grip.

In the experiments described above, adult males and females (including students) were selected as the "subjects" (or, persons to be tested) for the tests, and the tests were conducted as stated above. However, in case the "subjects" for the tests are, for example, pupils of a primary school, it was generally assumed that models each having an enlarged-diameter section whose diameter is smaller than that of the above-mentioned example are suitable, and then additional tests were carried out based on this assumption. The tests showed that models having the diameter of the enlarged-diameter section of up to about 15 mm had a good result. In case the subjects (that is, persons to be tested) are of relatively large built adults, it was assumed that models each having a larger enlarged-diameter section than that of the above example were suitable, and tests were carried out based on this assumption. The tests showed that models having the diameter of the enlarged-diameter section of up to about 25 mm had a good result.

Figure 20:
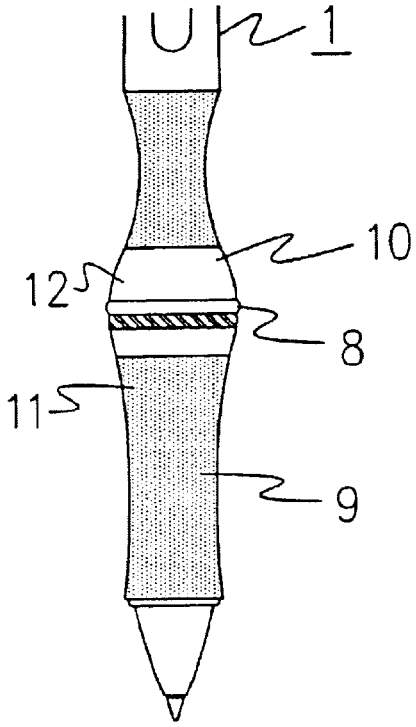
FIG. 20 is a front view of a part of the writing instrument according to a fifth embodiment of the present invention.
Figure 21:
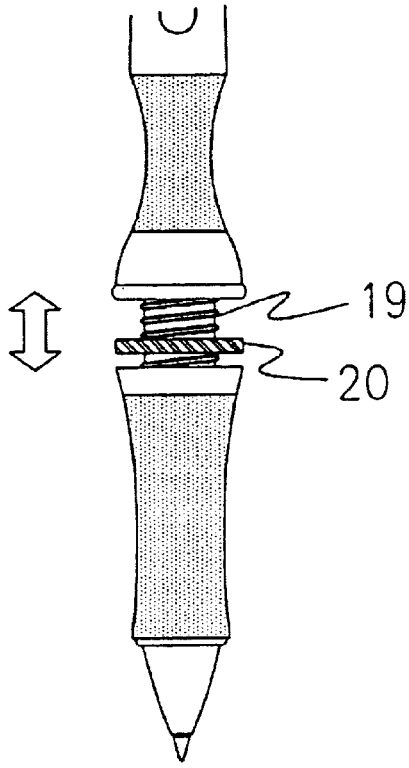
FIG. 21 is a front view of the writing instrument according to the fifth embodiment of the invention, showing one example of operation thereof.

Several examples of means for moving the enlarged-diameter section 8 in the longitudinal direction will now be described. The barrel 1 comprises two members, i.e., a front shaft part including a top metal (or ferrule), a grip section 9 and a reduced-diameter section 11, which are all located at the front part serving the enlarged-diameter section 8 as a border, and a rear shaft part including a reduced-diameter section 12, an interdigital abutment section 10 and a rear shaft, which are all located at the rear part serving the enlarged-diameter section 8 as a border. The front shaft part and the rear shaft part are threadingly integrally engaged with each other by an adjustment threaded part 19. An adjustment nut 20 is attached to the adjustment threaded part 19, so that the enlarged-diameter section 8 can be fixed after its position is adjusted. By those mechanisms, the interdigital abutment section 10 can be adjusted in position when the user grips the barrel 1 in such a manner as to correspond to the size of the user's hand. In the example of FIG. 20, the barrel 1 is gripped by a user who has a relatively small hand, and in the example of FIG. 21, the barrel 1 is gripped by a user who has a relatively large hand.

Figure 22:
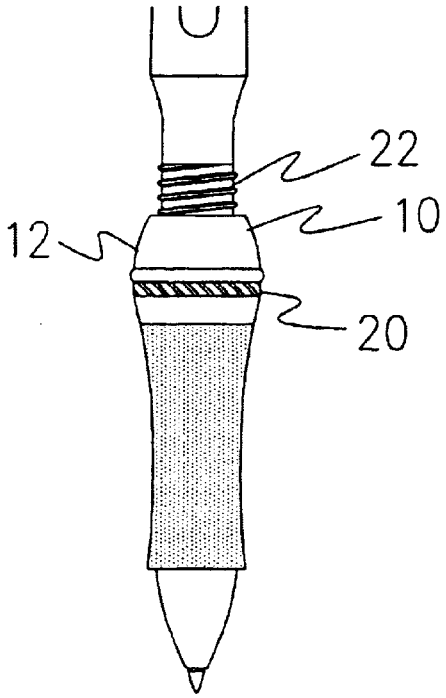
FIG. 22 is a front view showing a sixth embodiment of the present invention.
Figure 23:
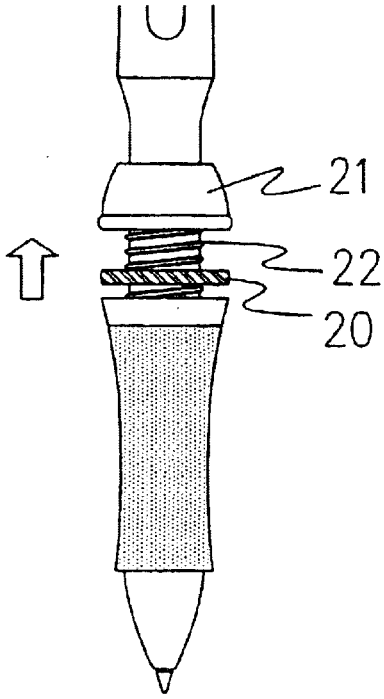
FIG. 23 is a front view of the writing instrument according to the sixth embodiment of the invention, showing one example of operation thereof.

FIGS. 22, 23 show a modified embodiment of the present embodiment. That is, the enlarged-diameter section 8 including the rear reduced-diameter section 12 is separately formed from the barrel 1 and defined as a movable member 21 which can move with respect to the barrel 1. This movable member 21 is threadingly engaged with a threaded part 22 which is formed on an intermediate part of the barrel 1, more specifically on a front part of the interdigital abutment section 10. An adjustment fixing nut 20 is also threadingly engaged with the threaded part 1 so that the movable member 21 will not move accidentally. That is, in the modified example shown in FIG. 20, the rear shaft is moved, and in the modified example shown in FIG. 22, the enlarged-diameter section 8 is moved.

Figure 24:
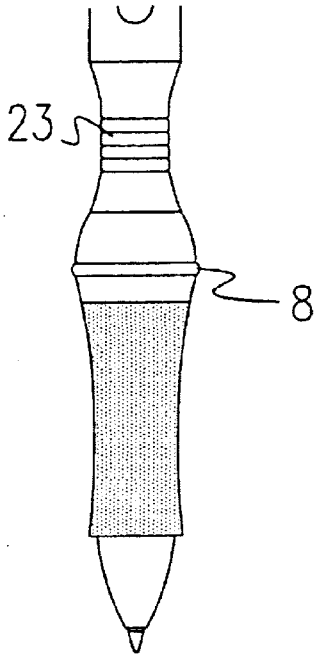
FIG. 24 is a front view showing the seventh embodiment of the present invention.
Figure 25:
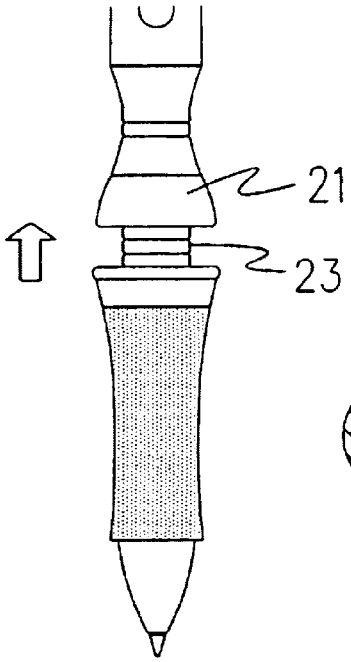
FIG. 25 is a front view of the writing instrument according to the seventh embodiment of the invention, showing one example of operation thereof.

A further embodiment of the invention will be described with reference to FIGS. 24 and 25, in which a plurality of adjustment rings 23 are aligned in an axial direction between a middle portion of the rear enlarged-diameter section 8 and the interdigital abutment section 10. By changing the location of the adjustment rings and the enlarged-diameter section 8 with each other, the position of the enlarged-diameter portion 8 relative to the aforementioned barrel 1 can be selectively adjusted.

Figure 28:
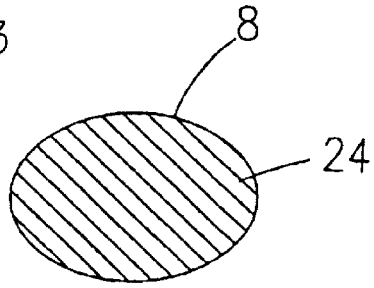
FIG. 28 is a cross-sectional view of the writing instrument, taken along 28—28 of FIG. 26.
Figure 26:
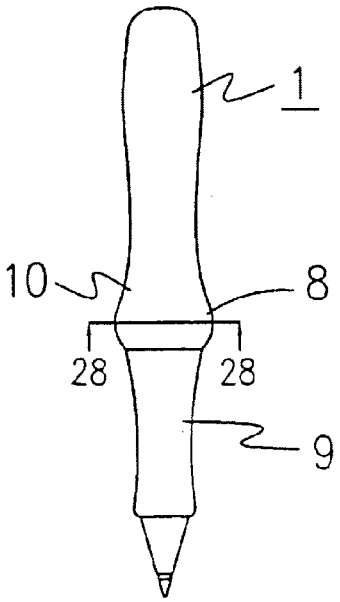
FIG. 26 is a front view of the writing instrument according to a eighth embodiment of the present invention.
Figure 27:
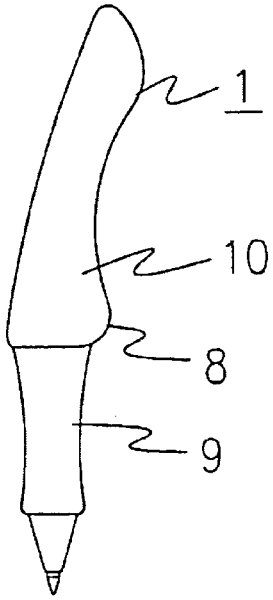
FIG. 27 is a side view of the writing instrument shown in FIG. 26.
Figure 29:
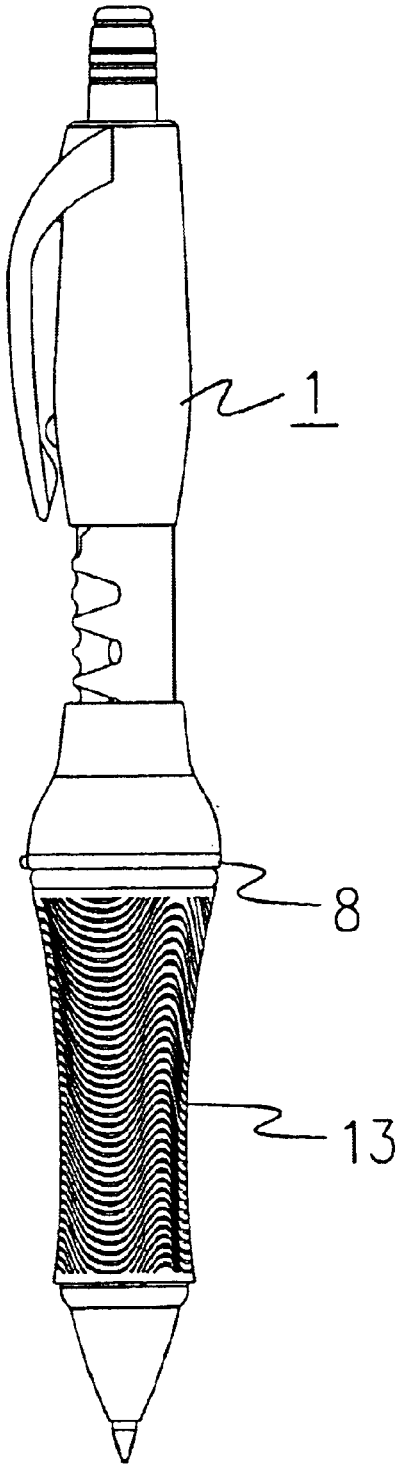
FIG. 29 is a side view of another writing instrument, showing a feature of a grip section thereof.
Figure 30:
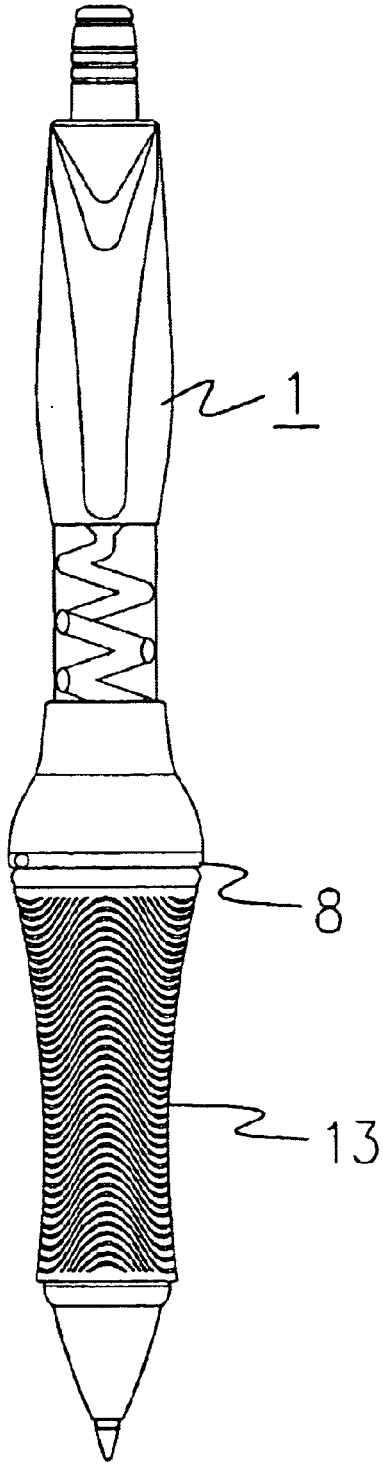
FIG. 30 is a front view of the writing instrument shown in FIG. 29.
Figure 31:
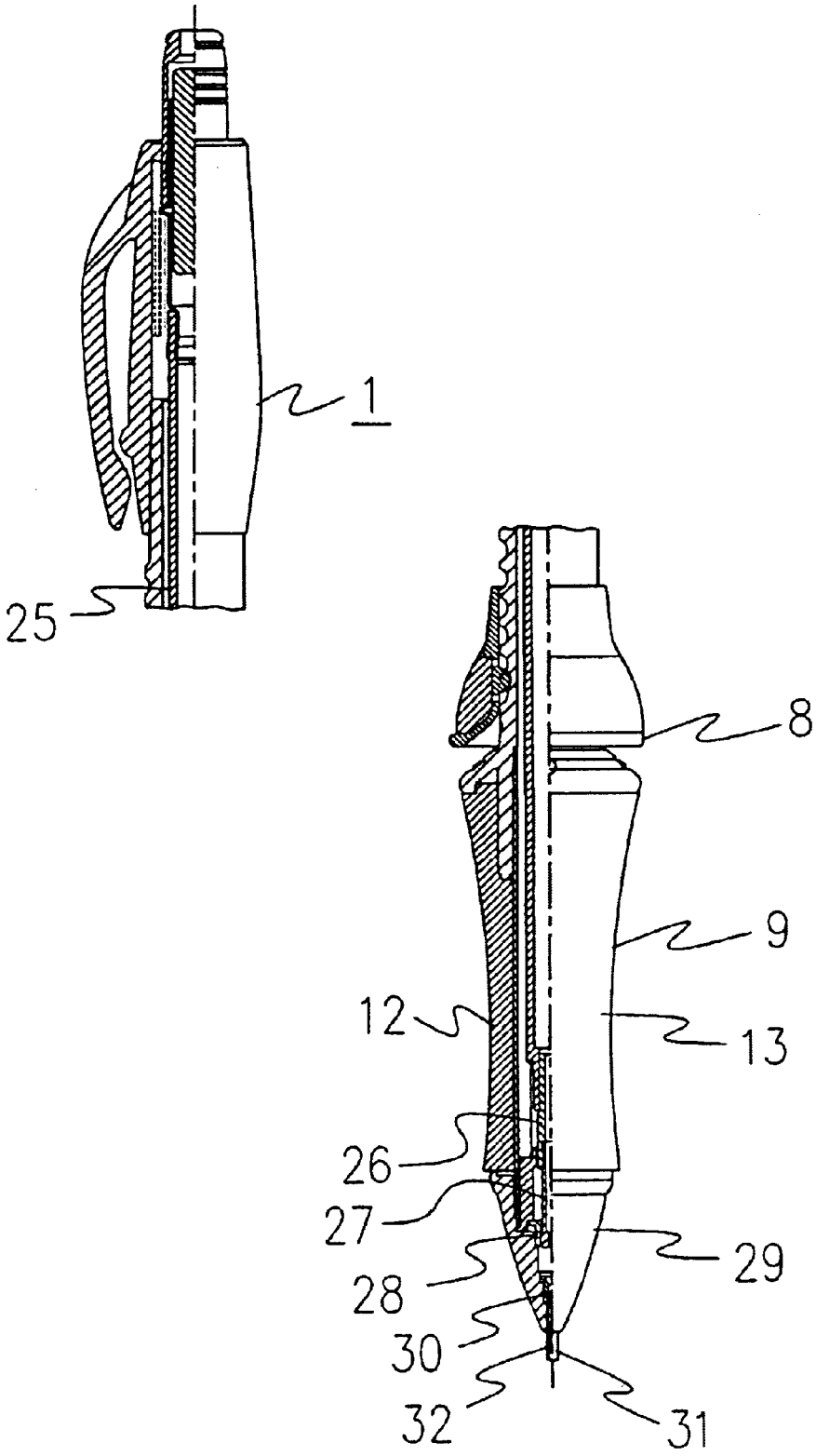
FIG. 31 is a vertical half-sectional view of the writing instrument shown in FIG. 29.
Figure 32:
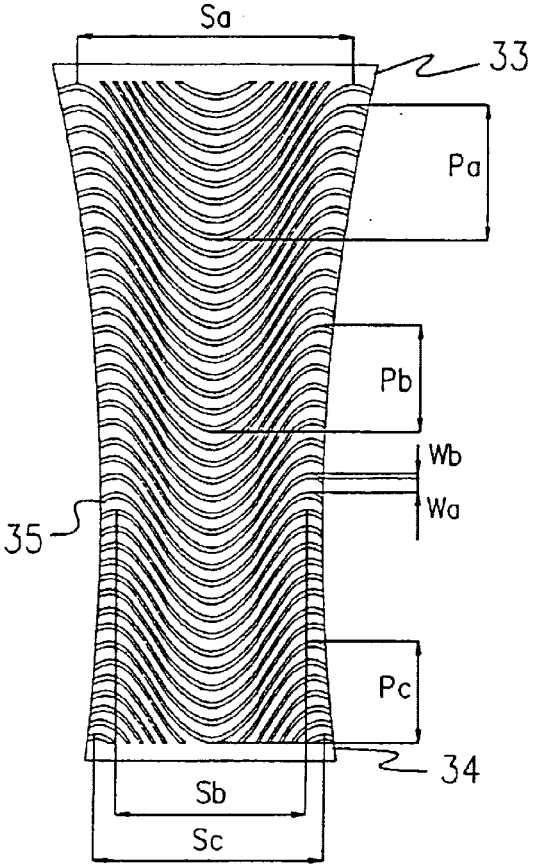
FIG. 32 is an enlarged view of the grip section.
Figure 33:
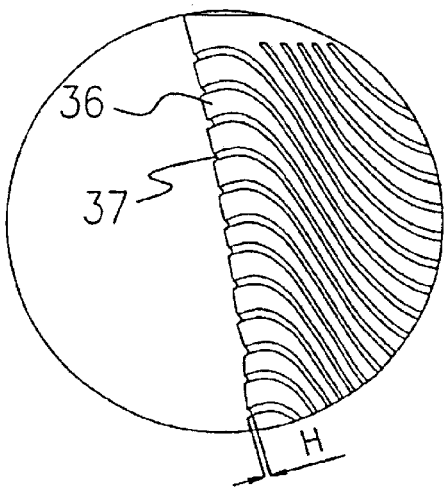
FIG. 33 is an enlarged view of an essential part of the grip section shown in FIG. 32.
Figure 34:
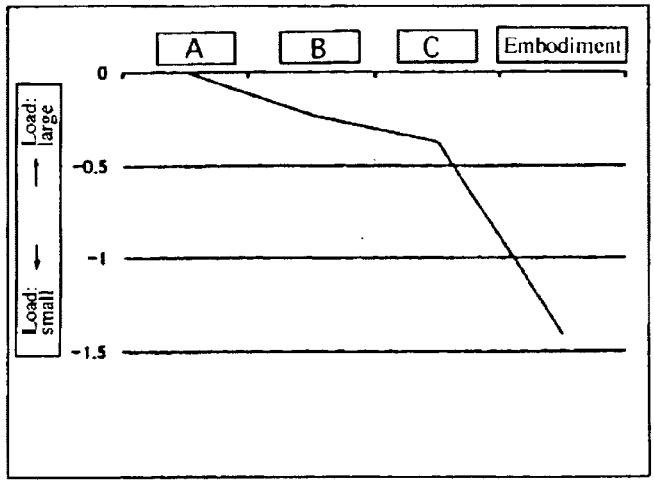
FIG. 34 is a diagram showing the result of the experiment made with respect to the grip section of the writing instrument.

Another embodiment will be described with reference to FIGS. 26 through 28. In this embodiment, the grip section 9, the enlarged-diameter section 8 and the interdigital abutment section 10 of the barrel 1 are formed with a reduced-diameter part, an enlarged-diameter part and a reduced-diameter part, respectively. Moreover, the enlarged-diameter section 8 and the interdigital abutment section 10 are deformed in section (deformed part 24). By deforming them in section, they can be well fitted to hand. Specifically, the sectional configuration from the enlarged diameter section 8 to the rear end of the barrel 1 is elliptical. The rear part from the enlarged-diameter section 8 via the interdigital abutment section 10 which is reduced in diameter in a deformed configuration to form the deformed part 24 is slightly warped from the center of the barrel 1 as shown in FIG. 27. That is, the interdigital abutment section 10 is curved. The deformed part 24 has a long diameter in a direction orthogonal to the curved direction of the barrel 1 (see FIG. 28).

By employing the above-mentioned configuration, the short diameter side of the ellipse may be abutted with the interdigital abutment section 10 in case the user's hand is relatively small. Similarly, the long diameter side of the ellipse may be abutted with the interdigital abutment section 10 even in case the user's hand is relatively large. By doing so, the writing instrument is stabilized. The feature in which the rear part of the barrel 1 is warped towards the palm side of the hand, is effective in enlarging the contact area between the writing instrument and the hand. Owing to this arrangement, the effect of the interdigital abutment section 10 can be exhibited more efficiently. By turning the barrel in the manner as mentioned above, the user can select the position which can well fit to the hand.

Next, the grip section 9 will be described in detail. In this embodiment, the present invention is applied to the grip section of a mechanical pencil. This example will now be described with reference to FIGS. 29 through 34. Description on the same components as in the above-mentioned embodiments is omitted for the purpose of simplification only. A lead tank 25 is slidingly movably disposed within the barrel 1. A chuck member 27 which is adapted and serves to grip and release the lead is attached to a front part of the lead tank 25 through a joint member 26.

A chuck ring 28 for dilating and closing the chuck member 27 is disposed at a front part of the chuck member 27 in such a manner as to surround it. A guide member 30 for guiding the lead is fixed to the inside of a tip member 29 which is located at a front end of the barrel 1. A lead protecting tube 31 made of a metal material is press fitted to a front part of the guide member 30. The lead protecting tube 31 may be formed integral with the tip member 31 by molding. A lead retainer 32, that is, a lead return stopper, made of a rubber material and adapted to prohibit rotation of the lead is inserted in the inner side of the lead projecting tube 31. An elastic member 13, which is the same as that of the above embodiment, is mounted on the grip section 9 of the mechanical pencil thus constructed.

The elastic member 13, that is the grip member 9, will now be described in detail. The elastic member 13 is provided at an upper and a lower part thereof with enlarged-diameter parts 33, 34, respectively. The upper enlarged-diameter part 33 is slightly larger than the lower enlarged-diameter part 34. The nearby area of the center of the elastic member 13 is defined as a reduced diameter part 35. The specific diameters of the upper enlarged-diameter part 33, the reduced-diameter part 35 and the lower enlarged-diameter part 34 are 18 mm, 12 mm and 14 mm, respectively. However, the present invention is by no means limited to those values. A corrugated projection 36 is formed on the surface of the elastic member 13. The amplitudes S of the corrugated projection 36 are different in such a manner as to correspond to the upper enlarged-diameter part 22, the reduced-diameter part 35 and the lower enlarged-diameter part 35. That is, the amplitude Sa at the upper enlarged-diameter part 33 is 15 mm, the amplitude Sb at the reduced-diameter part 35 is 11 mm, and the amplitude Sc at the lower enlarged-diameter part 34 is 12 mm. Likewise, the pitches P from the trough (valley) to the crest (hill) of the corrugated projection 36 are also different in such a manner as to correspond to the upper enlarged-diameter part 33, the reduced-diameter part 35 and the lower enlarged-diameter part 34. That is, the pitch Pa at the upper enlarged-diameter part 33 is 4 mm, the pitch Pb at the reduced-diameter part 35 is 3 mm, and the pitch Pc at the lower enlarged-diameter part 34 is 3.5 mm.

Although the groove 37 between the projections formed by forming the corrugated projection 36 is arcuate in section, the present invention is by no means limited to this. For example, it may be triangular or square in section. The width Wa of the corrugated projection 36 is larger than the width Wb of the groove 37. Specifically, the width Wa of the corrugated projection 36 is 1.0 mm, and the width Wb of the groove 37 is 0.3 mm.

Although the height H of the corrugated projection 36 is 0.3 mm, the present invention is by no mean limited to this embodiment, including the values of the amplitude S, the pitch P and the width W.

The following experiments were carried out using the writing instrument thus constructed. The experiments were measured by the electromyogram ("EMG") in order to check the load applicable to the muscle. EMG was drawn (band: 5 to 100 Hz and sampling frequency: 250 Hz)) from the flexor pollicis brevis ("FPB") of the right hand and the dorsal interosseous ("IOD") of the same. The number of tested persons was eight (adult male and female: 4 and 4, respectively, all right-handed). The models used in this experiment included, in addition to those of the present embodiment, experimental products A, B, C each having a grip of the same hardness, the surface of the grip being flat. As a result of an interlevel examination, it became clear that the load applicable to the muscle load of this embodiment is small (see FIG. 34).

The elastic member of this embodiment is slightly longer in the longitudinal direction than its mounting part. That is, in an inserted state to the barrel, the elastic member is attached in its compressed state. By this, occurrence of irregularities among the respective parts, formation of gaps due to deterioration with the passage of time, loosening of the tip member, etc. caused by shock can be prevented.

According to the present invention, there is provided a writing instrument including a barrel, the barrel comprising an enlarged-diameter section formed generally at a lengthwise central area thereof, a grip section disposed at a front part of the enlarged-diameter section and an interdigital abutment section disposed at a rear part of the enlarged-diameter section, the interdigital abutment section having a reduced-diameter. Accordingly, a writing instrument can be supported in a stable manner irrespective of the gripping manner and the grasping power of the user. Thus, a sufficiently large writing load can be obtained. Moreover, the writing instrument according to the present invention is excellent in portability and handling performance.

What is claimed is:

1. A writing instrument including a barrel, the barrel having an enlarged-diameter section generally at a lengthwise central area thereof and which is slidably movable in a longitudinal direction of the barrel, a grip section disposed at a front part of the enlarged-diameter section, an interdigital abutment section disposed at a rear part of the enlarged-diameter section and having a reduced-diameter, and locking means for selectively locking the enlarged-diameter section at a desired position.

2. A writing instrument according to claim 1, wherein at least one of the grip section and the interdigital abutment section is provided with a slip resistance.

3. A writing instrument according to claim 1, wherein the maximum outside diameter dimension of the enlarged-diameter section is 15 mm to 25 mm.

4. A writing instrument according to claim 1, wherein at least one of the grip section and the interdigital abutment section is provided with a slip resistance, and a corrugated projection is formed on the surface of the slip resistance, the corrugated projection defining a plurality of projections separated by grooves.

5. A writing instrument according to claim 4, wherein the width of the grooves formed between the projections is smaller than a width of the projections.

6. A writing instrument according to claim 4, wherein a top part of the corrugated projection is flat.

7. A writing instrument according to claim 4, wherein the grip section is formed with an enlarged-diameter section and a reduced-diameter section, and the corrugated projection is formed on the grip section and comprises corrugated projections of different amplitude formed respectively on the enlarged-diameter section and the reduced-diameter section.

8. A writing instrument according to claim 7, wherein the amplitude of the corrugated projection formed on the enlarged-diameter section is greater than the amplitude of the corrugated projection formed on the reduced-diameter section.

9. A writing instrument according to claim 4, wherein the width of the projections of the corrugated projection is 1.0 mm, and the width of the grooves formed between the projections is 0.3 mm.

10. A writing instrument comprising: a barrel containing therein a writing medium, the barrel having an enlarged-diameter section generally at a lengthwise central portion thereof, the enlarged-diameter section having a front part and a movable rear part slidably movable in the lengthwise direction of the barrel to different positions relative to the front part, a grip section connected to the front part of the enlarged-diameter section, an interdigital abutment section connected to the movable rear part of the enlarged-diameter section for movement therewith and having a reduced-diameter relative to the enlarged-diameter section, and a locking mechanism for releasably locking the movable rear part of the enlarged-diameter section at a desired position.

11. A writing instrument according to claim 10; wherein the locking mechanism comprises a plurality of recesses provided in the barrel at spaced-apart intervals in the lengthwise direction of the barrel, and a projection connected to the movable rear part and releasably engageable with a selected one of the recesses to releasably lock the movable rear part at the desired position.

12. A writing instrument according to claim 11; wherein each recess is angularly spaced from adjacent recesses.

13. A writing instrument according to claim 10; wherein the front part and the movable rear part of the enlarged-diameter section are threadedly connected together so that angular turning of one of the front and rear parts relative to the other effects relative movement of the front and rear parts in the lengthwise direction of the barrel.

14. A writing instrument according to claim 13; wherein the locking mechanism comprises a nut threadedly engaged with a shaft that threadedly connects together the front and rear parts.

15. A writing instrument according to claim 10; wherein at least one of the grip section and the interdigital abutment section has a corrugated surface having alternating projections and grooves.

16. A writing instrument according to claim 15; wherein the width of the grooves is smaller than the width of the projections.

17. A writing instrument according to claim 15; wherein each of the grip section and the interdigital abutment section has a corrugated surface having alternating projections and grooves.

18. A writing instrument according to claim 17; wherein the projections of the corrugated surface of the grip section have an amplitude different from that of the projections of the corrugated surface of the interdigital abutment section.

19. A writing instrument according to claim 10; wherein at least one of the grip section and the interdigital abutment section has a slip-resistant surface.

* * * * *